US010702110B2

(12) United States Patent
Kim et al.

(10) Patent No.: US 10,702,110 B2
(45) Date of Patent: Jul. 7, 2020

(54) ROBOT CLEANER

(71) Applicant: LG ELECTRONICS INC., Seoul (KR)

(72) Inventors: Jongsu Kim, Seoul (KR); Dongseong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 162 days.

(21) Appl. No.: 15/754,098

(22) PCT Filed: Aug. 12, 2016

(86) PCT No.: PCT/KR2016/008891

§ 371 (c)(1),
(2) Date: Feb. 21, 2018

(87) PCT Pub. No.: WO2017/034198

PCT Pub. Date: Mar. 2, 2017

(65) Prior Publication Data

US 2018/0242801 A1 Aug. 30, 2018

(30) Foreign Application Priority Data

Aug. 24, 2015 (KR) ..... 10-2015-0118685

(51) Int. Cl.
*A47L 9/00* (2006.01)
*A47L 9/16* (2006.01)
(Continued)

(52) U.S. Cl.
CPC ..... *A47L 9/0081* (2013.01); *A47L 9/009* (2013.01); *A47L 9/02* (2013.01); *A47L 9/165* (2013.01);
(Continued)

(58) Field of Classification Search
CPC ..... A47L 9/0081; A47L 9/009; A47L 9/1616; A47L 9/165; A47L 9/22; A47L 9/2884;
(Continued)

(56) References Cited

U.S. PATENT DOCUMENTS

2007/0214756 A1* 9/2007 Lee ..... A47L 9/165 55/419
2010/0064471 A1 3/2010 Stephens et al.
(Continued)

FOREIGN PATENT DOCUMENTS

JP 2013-022437 2/2013
JP 2013-240599 12/2013
(Continued)

OTHER PUBLICATIONS

European Search Report dated Feb. 1, 2019 issued in Application No. 16839487.2.
(Continued)

*Primary Examiner* — Robert J Scruggs
(74) *Attorney, Agent, or Firm* — KED & Associates, LLP

(57) ABSTRACT

Disclosed is a robot cleaner. The robot cleaner includes a cleaner main body defining an external appearance of the robot cleaner, a fan unit mounted in the cleaner main body for generating suction force, a suction unit provided in the cleaner main body and having a suction port for suctioning air containing dust via driving of the fan unit and a first discharge port and a second discharge port for discharging the air containing the dust, a first guide member coupled to the first discharge port, a second guide member coupled to the second discharge port, and a cyclone unit for separating the dust from the air suctioned through the suction port using centrifugal force, the cyclone unit having a first communication hole for communicating with the first guide member and a second communication hole for communicating with the second guide member.

20 Claims, 12 Drawing Sheets

(51) Int. Cl.
*A47L 9/22* (2006.01)
*A47L 9/28* (2006.01)
*A47L 9/02* (2006.01)

(52) U.S. Cl.
CPC ..... *A47L 9/1616* (2013.01); *A47L 9/1625* (2013.01); *A47L 9/1641* (2013.01); *A47L 9/22* (2013.01); *A47L 9/2884* (2013.01); *A47L 2201/00* (2013.01)

(58) Field of Classification Search
CPC .. A47L 2201/00; A47L 9/2842; A47L 9/2857; A47L 9/2889; A47L 9/2805; A47L 9/00
See application file for complete search history.

(56) References Cited

U.S. PATENT DOCUMENTS

2010/0088840 A1* 4/2010 Kim ..... A47L 5/14 15/320
2010/0263161 A1* 10/2010 Lee ..... A47L 5/362 15/347
2011/0088203 A1 4/2011 Song et al.
2013/0305484 A1* 11/2013 Dyson ..... A47L 9/009 15/353
2014/0182627 A1 7/2014 Williams et al.

FOREIGN PATENT DOCUMENTS

| | | |
|---|---|---|
| KR | 10-2006-0105390 | 10/2006 |
| KR | 10-2007-0064997 | 6/2007 |
| KR | 10-0959973 | 5/2010 |
| TW | 201316935 | 5/2013 |
| TW | 201519844 | 6/2015 |
| WO | WO 2008/099999 | 8/2008 |
| WO | WO 2014/105221 | 7/2014 |

OTHER PUBLICATIONS

International Search Report and Written Opinion dated Dec. 19, 2016 issued in Application No. PCT/KR2016/008891 (Full English Text).
Taiwanese Office Action dated Jun. 26, 2017 issued in application No. 105125767 (with English translation).

* cited by examiner

[Fig. 1]
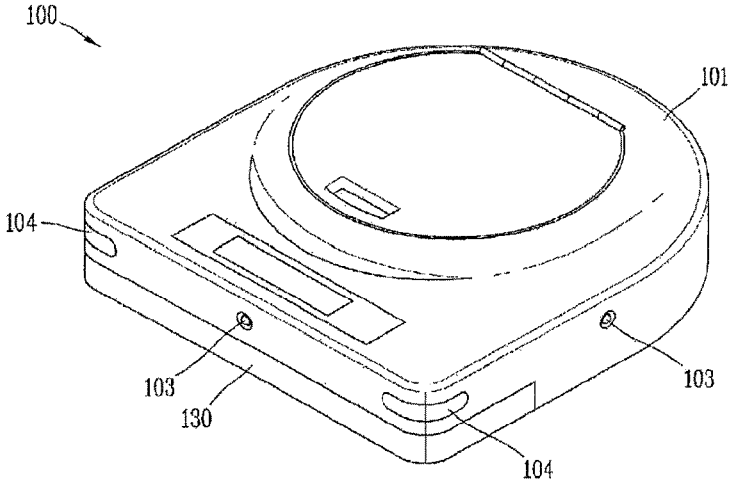
[Fig. 2]
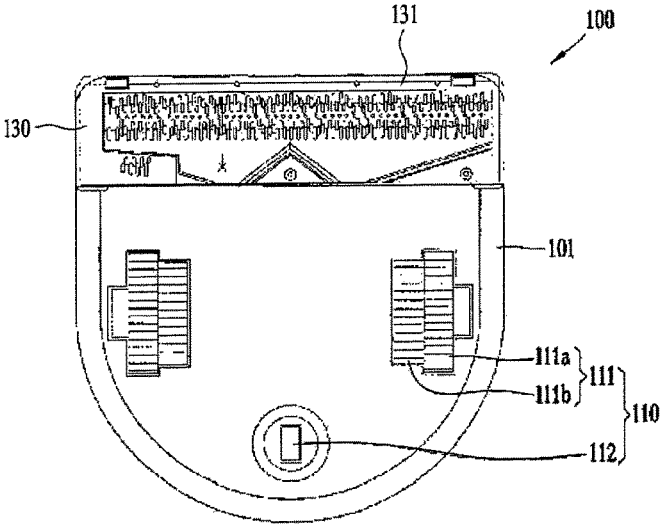
[Fig. 3]
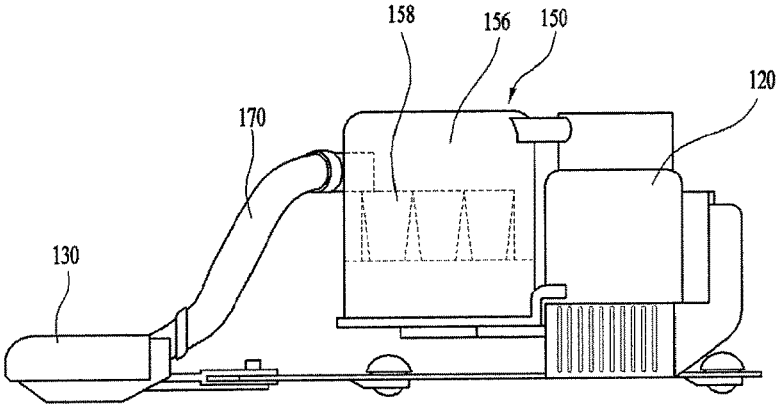

[Fig. 4]
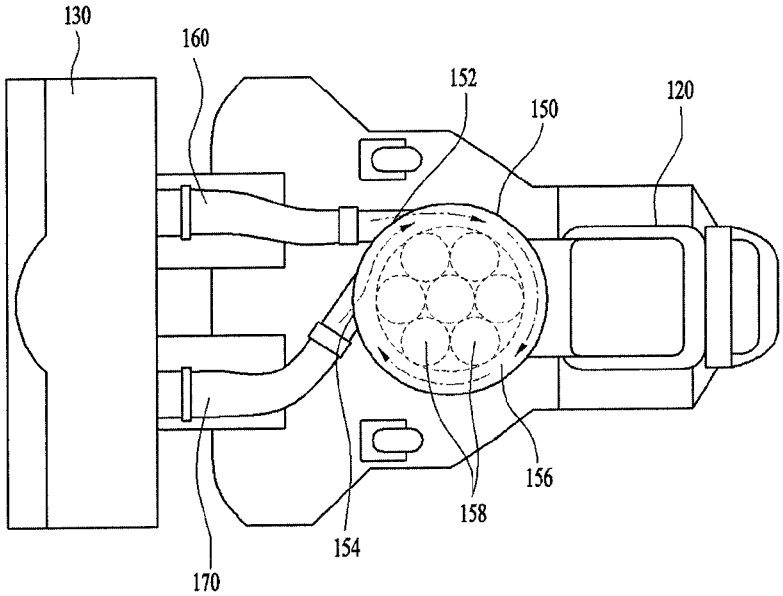
[Fig. 5]
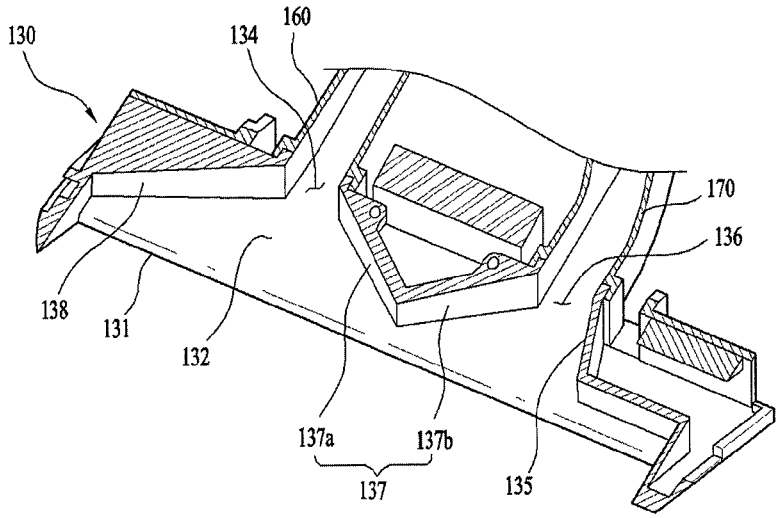

[Fig. 6]
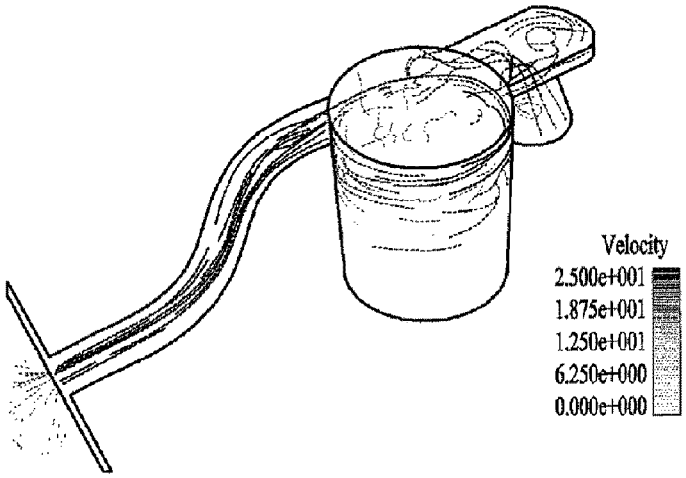
(a)
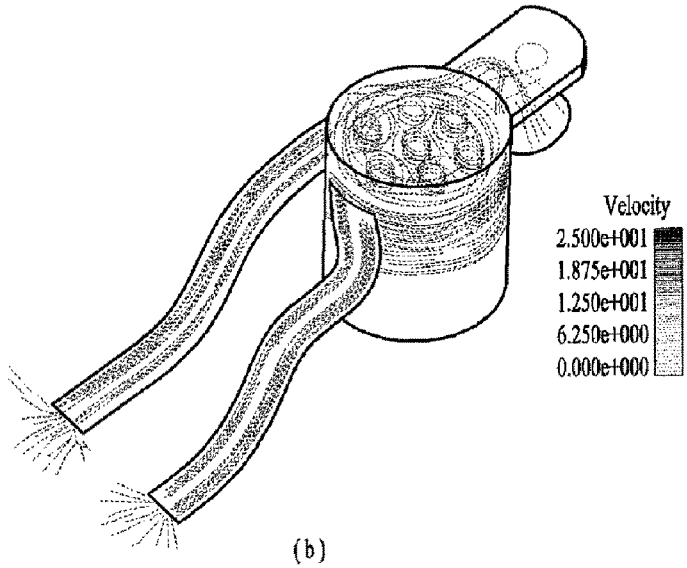
(b)

[Fig. 7]
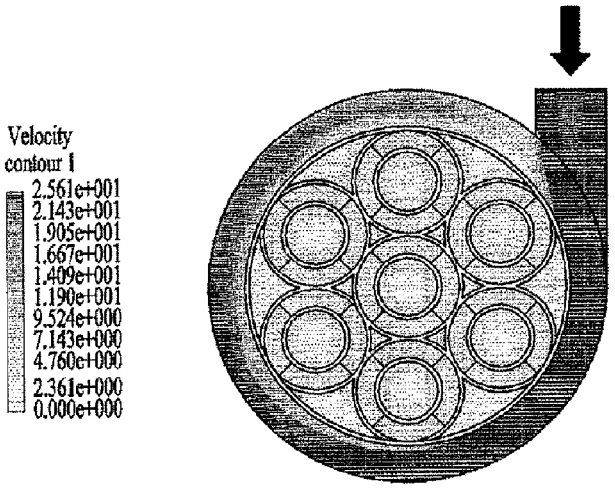
(a)
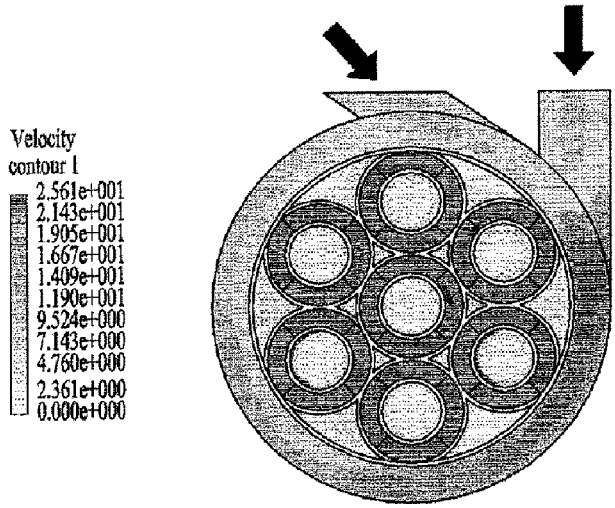
(b)

[Fig. 8]
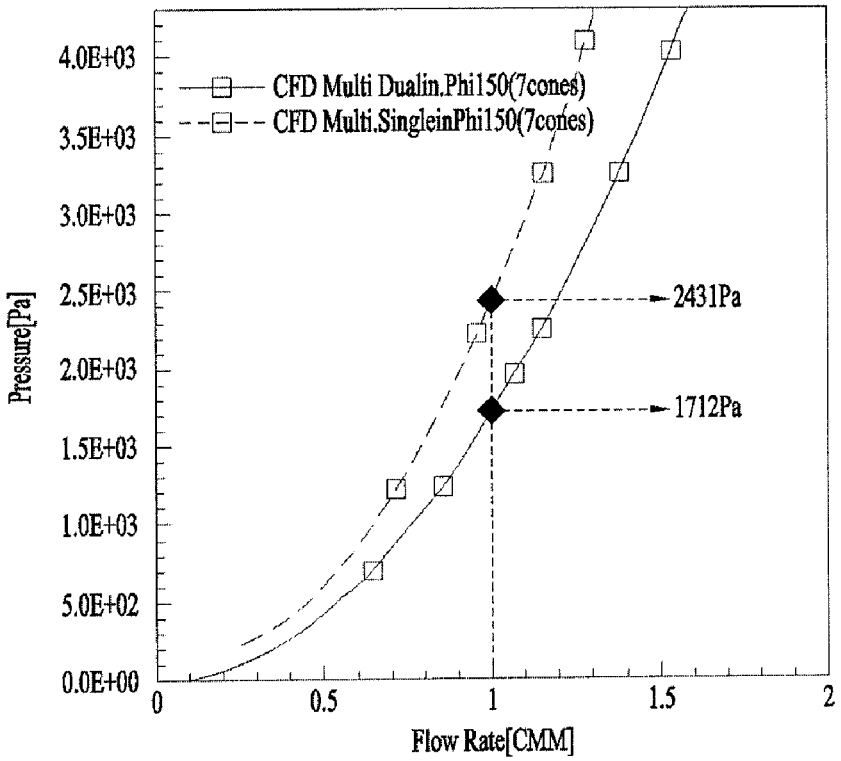
Figure 1. Comparison Pressure Loss between 2-in-1 & Multi

[Fig. 9]
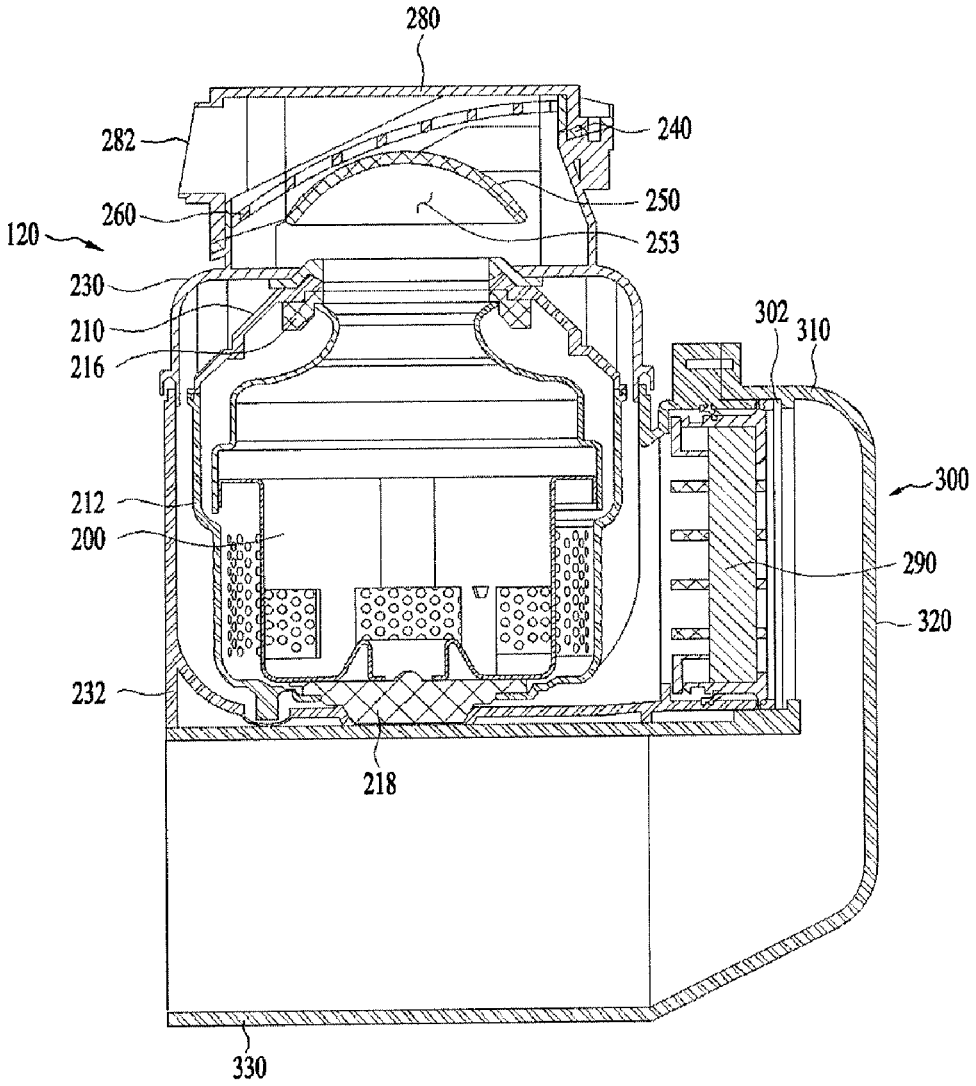

[Fig. 10]
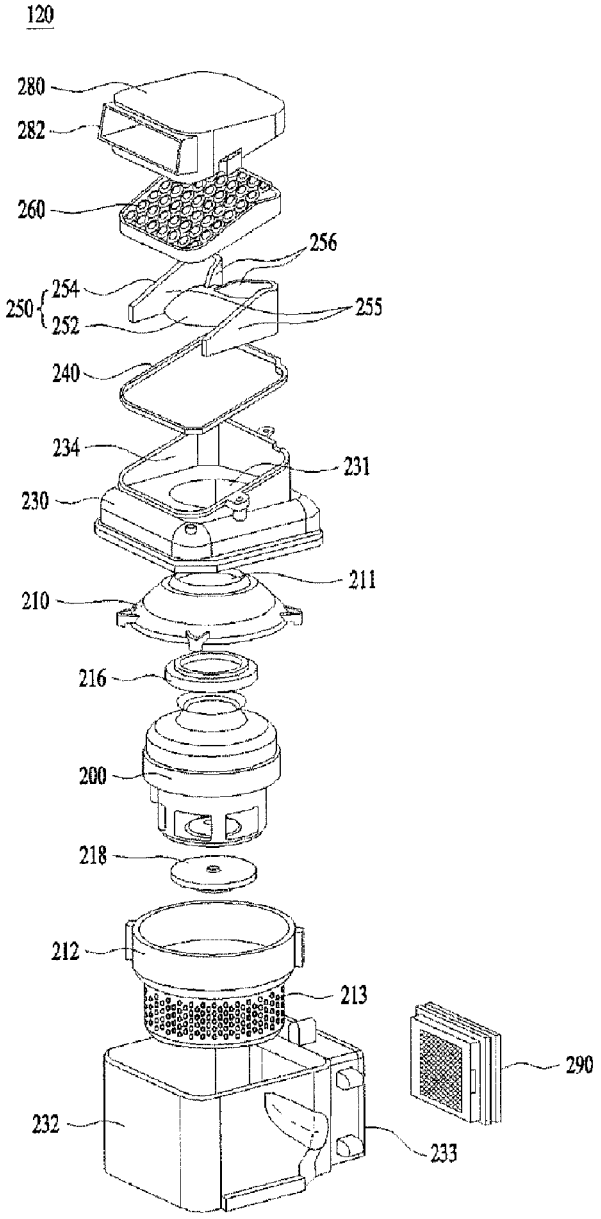
[Fig. 11]
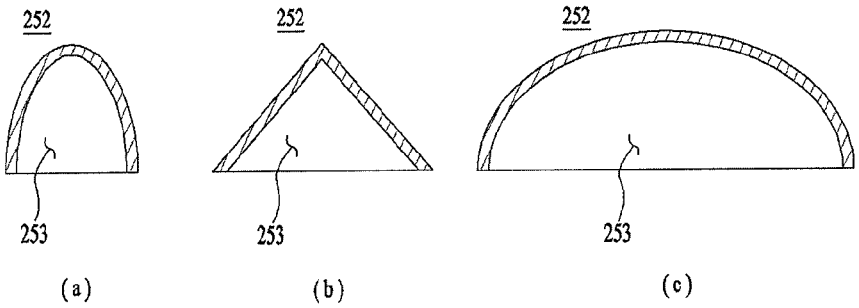

[Fig. 12]
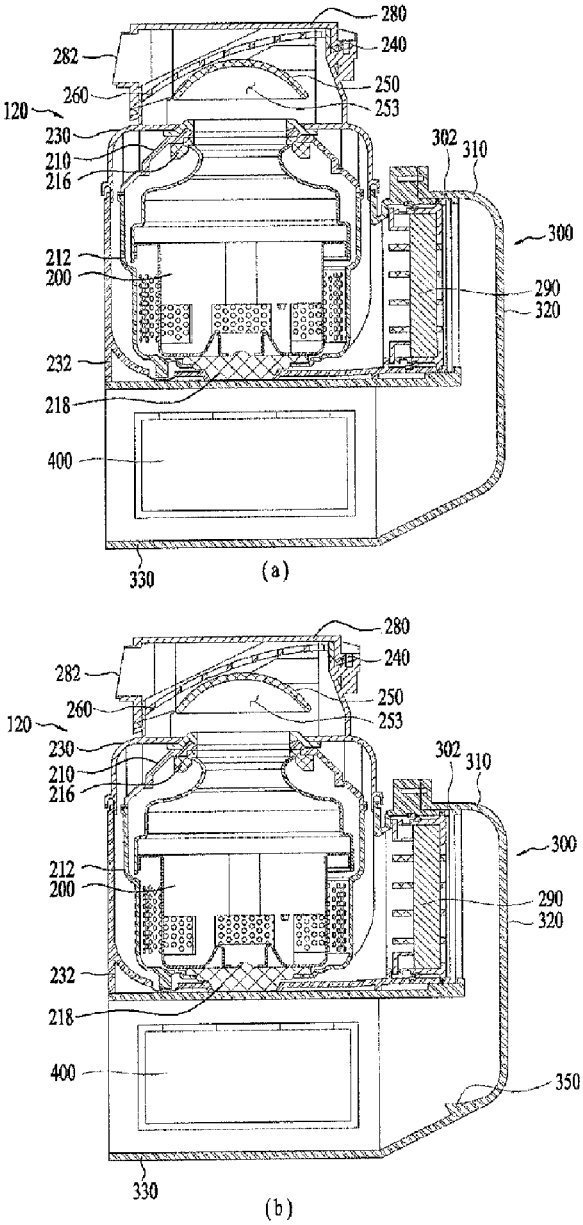

[Fig. 13]
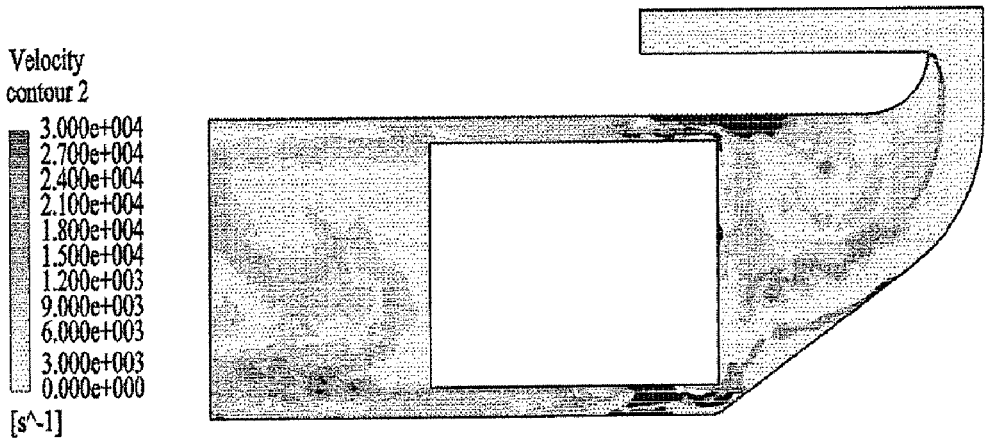
(a)
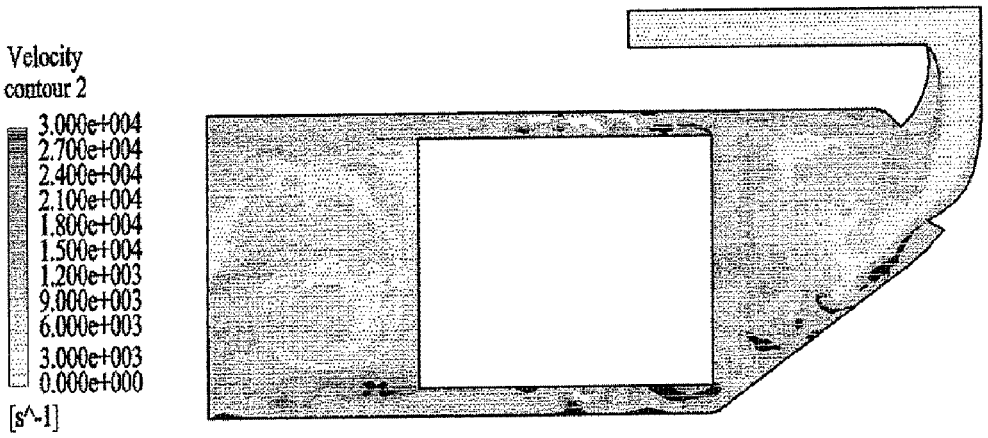
(b)

[Fig. 14]
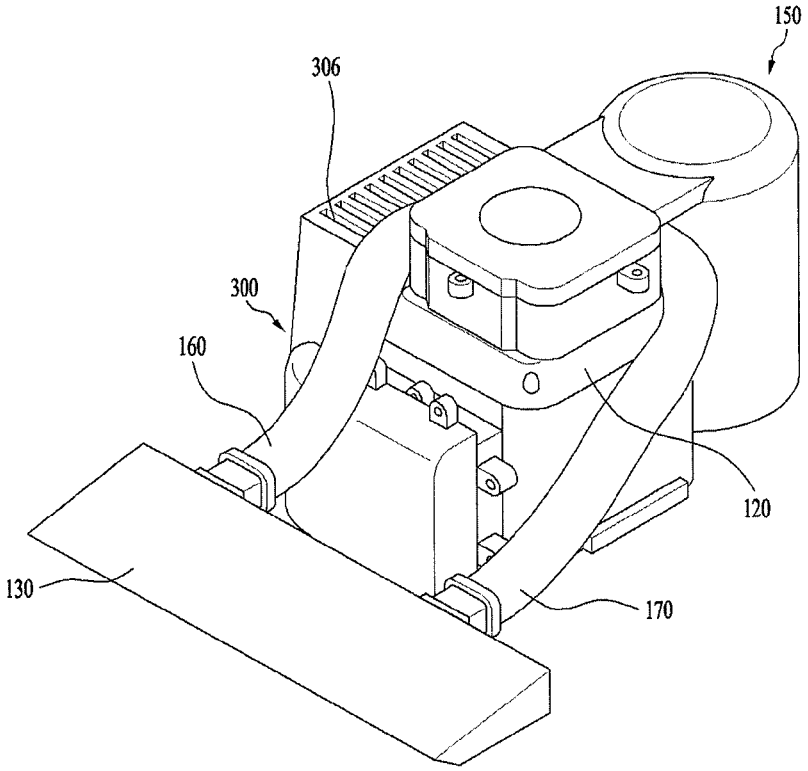
[Fig. 15]
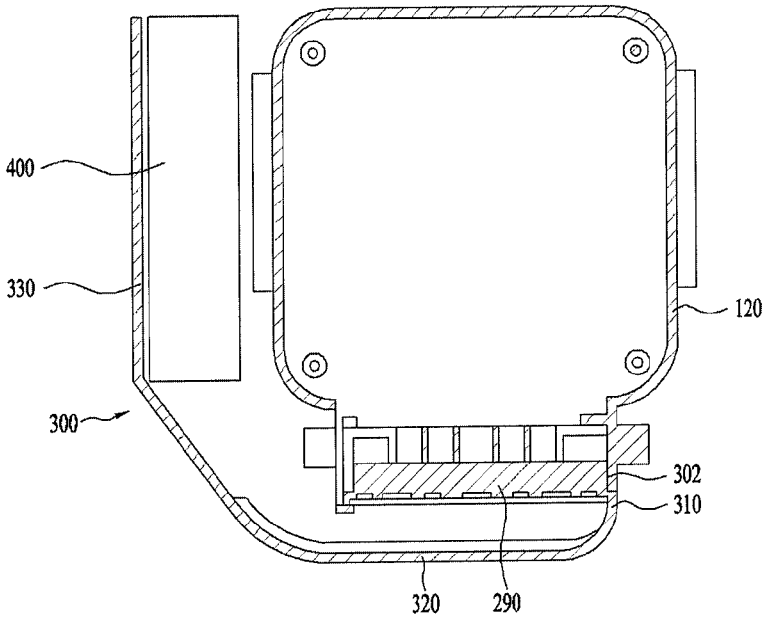

[Fig. 16]
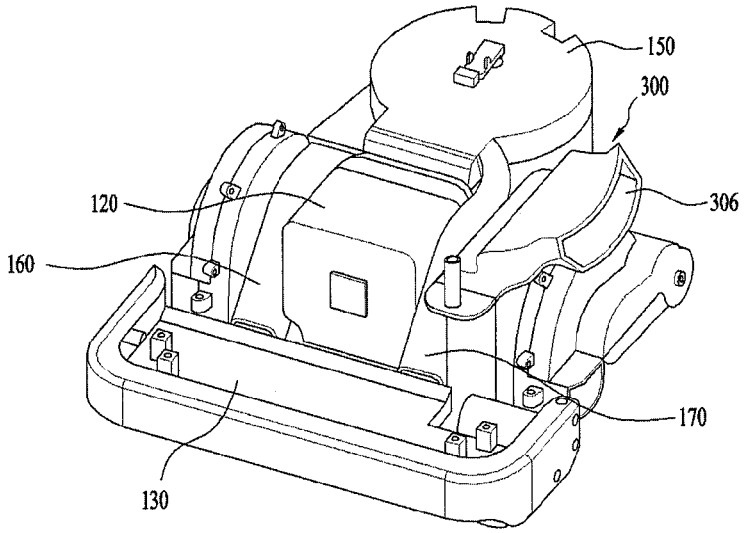
[Fig. 17]
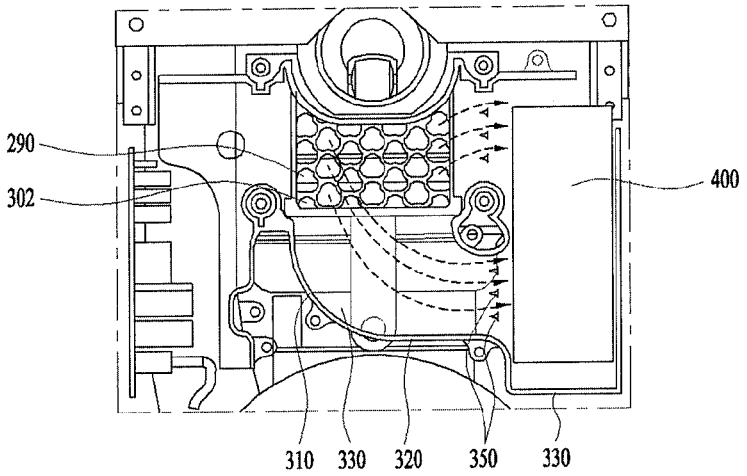

[Fig. 18]
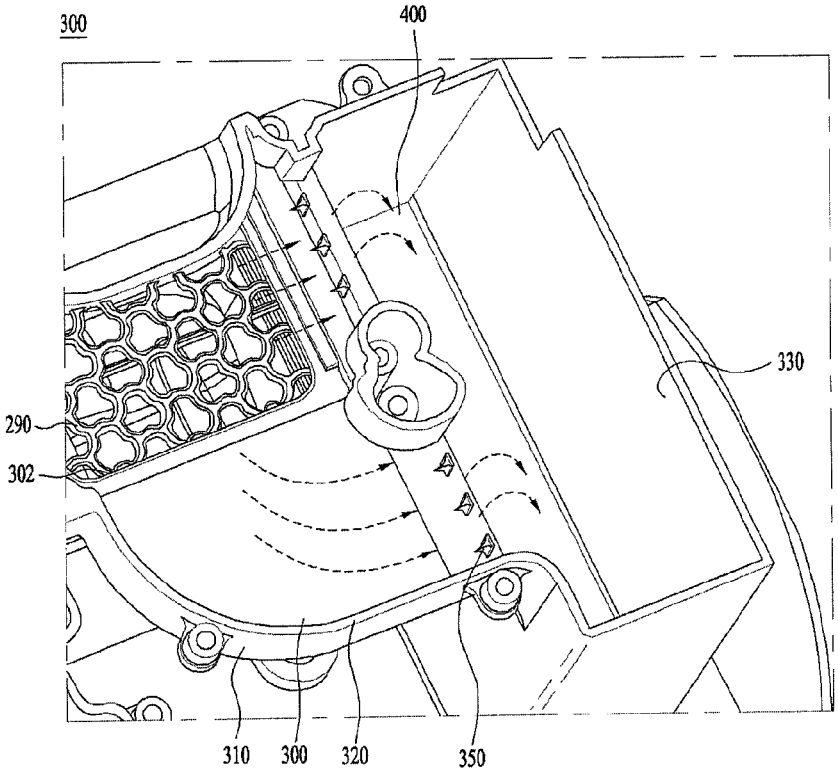

ROBOT CLEANER

CROSS-REFERENCE TO RELATED PATENT APPLICATIONS

This application is a U.S. National Stage Application under 35 U.S.C. § 371 of PCT Application No. PCT/KR2016/008891, filed Aug. 12, 2016, which claims priority to Korean Patent Application No. 10-2015-0118685, filed Aug. 24, 2015, whose entire disclosures are hereby incorporated by reference.

TECHNICAL FIELD

The present invention relates to a robot cleaner having improved cleaning performance and, more particularly, to a robot cleaner capable of efficiently suctioning impurities, such as, for example, dust.

In addition, the present invention relates to a robot cleaner capable of reducing the amount of noise that is generated.

In addition, the present invention relates to a robot cleaner capable of efficiently cooling inner constituent elements thereof.

BACKGROUND ART

Generally, robots are developed as industrial robots and take charge of part of factory automation. With the recent broadening of fields using robots, domestic robots, which may be used in general homes, as well as aerospace robots and medical robots have been made.

A representative example of domestic robots may be a robot cleaner. The robot cleaner performs a cleaning function by suctioning dust (including impurities) from a floor while autonomously traveling in a certain area.

The robot cleaner generally includes a rechargeable battery and an obstacle detection sensor to enable the avoidance of obstacles during traveling, thereby performing autonomous traveling and cleaning.

The robot cleaner is configured to suction air containing dust, to catch the dust using a filter, and to discharge the air from which the dust has been removed. Accordingly, the filter is easily contaminated due to the dust accumulated thereon, and the contaminated filter undergoes deterioration in suction force, which results in deterioration in cleaning performance.

In addition, a battery having a greater capacity needs to be installed as the use time of the robot cleaner is increased. The battery may generate an increased amount of heat as the period of use thereof increases. To solve this problem, technologies for cooling the battery have been studied.

Various studies have been conducted in order to increase the efficiency of cleaning of the robot cleaner.

In addition, when attempting to increase suction force in order to enhance cleaning performance, the generation of noise is increased upon the suction and discharge of air. To solve this problem, a structure capable of reducing noise while maintaining an increase in suction force has actively been studied.

DISCLOSURE OF INVENTION

Technical Problem

Therefore, the present invention has been made in view of the above problems, and it is one object of the present invention to provide a robot cleaner capable of efficiently suctioning dust from an area over which a suction unit passes.

In addition, it is another object of the present invention to provide a robot cleaner capable of reducing the amount of noise that is generated therefrom.

In addition, it is a further object of the present invention to provide a robot cleaner capable of cooling a battery during the operation thereof.

Solution to Problem

In accordance with one aspect of the present invention, the above and other objects can be accomplished by the provision of a robot cleaner including a fan unit for generating suction force, a suction unit for suctioning air containing dust, a first guide member coupled to a first discharge port, a second guide member coupled to a second discharge port, and a cyclone unit for separating the dust from the air suctioned through a suction port using centrifugal force, the cyclone unit having a first communication hole for communicating with the first guide member and a second communication hole for communicating with the second guide member.

The suction unit may include the suction port for suctioning the air containing the dust via driving of the fan unit, and the first discharge port and the second discharge port for discharging the air containing the dust, whereby the dust and the air, suctioned through one suction port, may be divided and discharged to two first and second discharge ports. That is, one suction port may encounter suction force supplied through the two first and second discharge ports.

In the present invention, after the dust and the air, suctioned through one suction port, is divided to two discharge sports, the dust and the air may again be mixed in one cyclone unit, and may then be separated from each other. That is, although one constituent element for separating the dust and the air from each other is used, flow paths for movement of the dust and the air may be increased before the separation of the dust and the air, and the suction force may be dispersed to the respective flow paths, which may improve suction efficiency by which the overall dust and air is suctioned.

Because the first discharge port and the second discharge port may be separated from each other in the suction unit and are arranged at different position, the suction force supplied to the suction port may be uniformly distributed over an increased number of positions.

The air guided by the first guide member and the air guided by the second guide member may be mixed with each other in the cyclone unit, thereby being rotated in the cyclone unit. Accordingly, it is unnecessary to separately drive two cyclone units.

The suction unit may include a separator for separating the first discharge port and the second discharge port from each other, the separator may include a first partition for guiding the air to the first discharge port and a second partition for guiding the air to the second discharge port, and the first partition and the second partition may be arranged to form an acute angle therebetween. Because the first discharge port and the second discharge port define different air flow paths, the suction force inside the suction unit may be relatively uniformly distributed.

The suction unit may include a third partition placed to face the first partition for guiding the air to the first discharge port, and a fourth partition placed to face the second partition for guiding the air to the second discharge port.

When the first partition and the third partition are paired and the second partition and the fourth partition are paired, the resistance of the air guided to the first discharge port and the second discharge port may be reduced.

The suction port may have a width greater than a sum of widths of the first discharge port and the second discharge port, the suction port may be formed as a single hole, and the air suctioned through the suction port may be divided and guided to the first discharge port and the second discharge port, but may again be merged in the cyclone unit so that the air and the dust may ultimately be separated from each other.

The suction port may be located in a bottom surface of the suction unit, and the first discharge port and the second discharge port may be located in a rear surface of the suction unit. The bottom surface of the suction unit may be inclined upward with decreasing distance to a rear end of the suction unit. Because of the inclination of the inclined surface, the air suctioned through the suction port formed in the bottom surface may be easily guided while encountering a small resistance when moving to the first discharge port and the second discharge port, which are located at higher positions than the suction port.

The first guide member and the second guide member may be coupled to the first discharge port and the second discharge port in a direction perpendicular to a direction of movement of the air, whereby the air having passed through the first discharge port and the second discharge port may easily move to the first guide member and the second guide member.

The first communication hole and the second communication hole may be located on an outer circumference of the cyclone unit, the first guide member may be coupled to the first communication hole so as to extend in a tangential direction of the cyclone unit, and the second guide member may be coupled to the second communication hole so as to extend in a tangential direction of the cyclone unit. Thereby, the air and the dust, discharged from the first guide member and the second guide member, may be easily rotated in the cyclone unit. Accordingly, the separation of the dust and the air may be efficiently performed in the cyclone unit.

Various alterations are possible. For example, the first communication hole and the second communication hole may be arranged at the same height, or may be arranged at different heights. At this time, the first communication hole and the second communication hole may have the same cross-sectional area, or may have different cross-sectional areas.

The cyclone unit may be a multi-cyclone including a first cyclone and a second cyclone, and the second cyclone may be provided in a plural number and may be accommodated inside the first cyclone. In this case, lower ends of the first communication hole and the second communication hole may be located on the upper end of the second cyclones. The overall efficiency of the cyclone unit for separating the dust and the air discharged from the first guide member and the second guide member may be increased when the second cyclones exert the maximum function thereof. To this end, the first communication hole and the second communication hole must be located on the upper end of the second cyclones.

In accordance with another aspect of the present invention, there is provided a robot cleaner including a cleaner main body defining an external appearance of the robot cleaner, a suction unit provided in the cleaner main body for suctioning air containing dust, a dust separation unit for separating the dust from the air suctioned through the suction unit, a fan unit coupled to the dust separation unit for providing suction force to the suction unit, and a housing having an air flow path for guiding the air discharged from the fan unit.

The housing may provide a path, along which the air is movable inside the robot cleaner main body in order to discharge the air having passed through the fan unit to an outside of the robot cleaner. The housing may accommodate a battery for supplying electricity to the fan unit, and the air passing through the air flow path may exchange heat with the battery.

The battery may supply electricity to the fan unit so that the fan unit generates suction force by driving a drive motor. In addition, the battery may also supply electricity to a moving unit, which moves the cleaner main body.

The housing may be provided at an inlet thereof with an exhaust filter, and the air having passed through the exhaust filter may pass through the air flow path and may then discharged to the outside through an outlet. Thereby, the dust contained in the air discharged from the fan unit may be caught. In addition, because the air having passed through the exhaust filter is introduced into the housing, it is possible to prevent the dust from accumulating in the housing.

The housing may include a first communication portion for guiding the air in a direction perpendicular to the exhaust filter, a second communication portion extending from the first communication portion for changing a direction of movement of the air, and a third communication portion extending from the second communication portion for guiding the air in a direction opposite to the direction of movement of the air in the first communication portion. That is, the air may be guided inside the housing based on the shape of the housing while sequentially passing through the first communication portion, the second communication portion, and the third communication portion.

The battery may be located in the third communication portion. The air that has sequentially passed through the first communication portion and the second communication portion may come into contact with the battery in the third communication portion. Some of the air may exchange heat with the battery by coming into contact with the battery in the third communication portion, and some of the air may exchange heat with the battery via, for example, convection of the air that has come into contact with the battery, thereby cooling the battery.

The housing may be provided with a protrusion for changing the moving air into a turbulent flow. The air passing through an inside of the housing may be changed from a laminar flow to a turbulent flow.

The protrusion may be provided in the second communication portion, so as to generate a turbulent flow before the battery installed in the third communication portion comes into contact with the air.

The suction unit, the dust separation unit, and the fan unit may be arranged in sequence from a front side to a rear side.

With the above-described arrangement, in the housing, the first communication portion may be located at a rear side of the fan unit, the second communication portion may be located at a lower side of the first communication portion, and the third communication portion may be located at a lower side of the fan unit. That is, the first communication portion, the second communication portion and the third communication portion may be arranged to surround one side of the fan unit, whereby inner constitute elements of the robot cleaner may be efficiently arranged in a small space.

The suction unit, the fan unit, and the dust separation unit may be arranged in sequence from a front side to a rear side.

With this arrangement, the first communication portion may be located at a front side of the fan unit, the second communication portion may be located at a left side of the first communication portion, and the third communication portion may be located at a left side of the fan unit. That is, the first communication portion, the second communication portion and the third communication portion may be arranged to surround one side of the fan unit, whereby inner constituent elements of the robot cleaner may be efficiently arranged in a small space.

Likewise, the first communication portion may be located at a lower side of the fan unit, the second communication portion may be located at a right side of the first communication portion, and the third communication portion may be located at a right side of the fan unit. That is, the first communication portion, the second communication portion and the third communication portion may be arranged to surround one side of the fan unit, whereby inner constituent elements of the robot cleaner may be efficiently arranged in a small space.

In accordance with another aspect of the present invention, there is provided a robot cleaner including a cleaner main body defining an external appearance of the robot cleaner, a suction unit provided in the cleaner main body for suctioning air containing dust, a dust separation unit for separating the dust from the air suctioned through the suction unit, and a fan unit connected to the dust separation unit for providing suction force to the suction unit.

The fan unit may include a drive motor for providing rotational power to generate suction force, a first chamber surrounding the drive motor and provided with a first suction hole and a first exhaust hole, and a second chamber surrounding the first chamber and provided with a second suction hole and a second exhaust hole.

The first chamber may surround the drive motor, and the second chamber may surround the first chamber so that the drive motor may be wholly surrounded by the first chamber and the second chamber.

Accordingly, noise generated from the drive motor may be primarily shielded by the first chamber and may be secondarily shielded by the second chamber. Thereby, it is possible to prevent noise and vibration from being transmitted to a user.

The first chamber may include a first chamber upper member for defining an external appearance of an upper portion, and a first chamber lower member coupled to the first chamber upper member for defining an external appearance of a lower portion. As such, the first chamber may be configured to accommodate the drive motor therein.

The first suction hole may be formed in the first chamber upper member, and the first exhaust hole may be formed in the first chamber lower member. As such, the first suction hole and the first exhaust hole may be located in different members.

The first suction hole may be formed to face an upper side and the first exhaust hole may be formed to face a lateral side. Thereby, when the air introduced through the first suction hole is discharged to the first exhaust hole, it is possible to prevent an abrupt variation in the path of movement of the air, thereby preventing an increase in the resistance of air.

The first chamber lower member may include a first vibration attenuator for supporting the drive motor by coming into contact with a bottom of the drive motor, and the first chamber upper member may include a second vibration attenuator for supporting the drive motor by coming into contact with a top of the drive motor. The top of the drive motor may come into contact with the first vibration attenuator, and the bottom of the drive motor may come into contact with the second vibration attenuator. The first vibration attenuator and the second vibration attenuator may absorb vibrational energy by being deformed or compressed when vibrations are generated, thereby attenuating noise and vibration generated from the drive motor.

The second chamber may include a second chamber upper member for defining an external appearance of an upper portion, and a second chamber lower member coupled to the second chamber upper member for defining an external appearance of a lower portion, so that the first chamber may be located inside the second chamber upper member and the second chamber lower member.

The second suction hole may be formed in the second chamber upper member, and the second exhaust hole may be formed in the second chamber lower member. When the second suction hole and the second exhaust hole are separated from each other so as to be located at different positions, the air may move at a constant flow rate through the second suction hole and the second exhaust hole.

The second exhaust hole may be provided with an exhaust filter, so as to catch the dust contained in the air to be discharged outward through the second exhaust hole. In addition, because the exhaust filter has a predetermined level of sealing performance unlike an empty space, noise generated from the drive motor may not be directly transmitted outward through the second exhaust hole, but may be reduced by the exhaust filter.

The fan unit may include a cover placed at an upper side of the second suction hole for preventing noise generated from the drive motor from being emitted through the second suction hole. Although the cover is located at the upper side of the second suction hole, the cover may be spaced apart from the second suction hole and may be sized to cover the entire second suction hole when viewed from the top, in order to reduce noise discharged through the second suction hole and to prevent the cover from blocking the flow of air introduced into the second suction hole.

The cover may include a cover portion for blocking a path of noise transmitted through the second suction hole, and a support portion for seating the cover portion on a top of the second chamber. The cover portion may shield noise, and the support portion may allow the cover portion to be located at the center of the second suction hole without blocking the path of movement of air to the second suction hole.

The support portion may include a support piece seated on the top of the second chamber, and an arm fixed to a top of the cover portion, and the arm may be a member having a width smaller than a height thereof. Because the arm may block the movement of air introduced into the second suction hole, the width of the arm may be as small as possible.

The cover portion may be configured so that an upper portion thereof has a smaller cross-sectional area than a lower portion thereof. As such, the air, moved from the top to the bottom of the cover portion and introduced into the second suction hole, may move while encountering a small resistance.

The cover portion may have a recess formed therein, thereby achieving an increased effect of shielding the noise because a surface by which the noise transmitted through the second suction hole located therebelow is reflected has a curved shape. In particular, the recess may be located to face the second suction hole.

The robot cleaner may further include a guide unit having an opening for guiding the air guided from the dust separation unit to the fan unit, and the cover may be located between the opening and the second suction hole. The cover may have the above-described shape so as not to block the flow path of air guided from the opening to the second suction hole.

The guide unit may include a mesh for widely distributing the air having passed through the dust separation unit. The air having passed through the mesh may be uniformly distributed at the upper side of the cover. Accordingly, the air may move to a portion over which the cover is not located, which may reduce the flow paths of air blocked by the cover. In addition, some of the noise of the drive motor emitted from the second suction hole may be shielded by the mesh.

In accordance with a further aspect of the present invention, there is provided a robot cleaner including a cleaner main body defining an external appearance of the robot cleaner, a suction unit provided in the cleaner main body for suctioning air containing dust, a dust separation unit for separating the dust from the air suctioned through the suction unit, a fan unit connected to the dust separation unit for providing suction force to the suction unit, and a housing having an air flow path for guiding the air discharged from the fan unit and accommodating a battery for supplying electricity to the fan unit, wherein the battery exchanges heat with the air passing through the air flow path, and wherein the housing includes a first communication portion extending from an inlet, the air discharged from the fan unit being introduced into the housing through the inlet, a second communication portion extending from the first communication portion for changing a direction of movement of the air, and a third communication portion for guiding the air in a direction opposite to a direction of movement of the air in the first communication portion.

The second communication portion may move the air downward to a position lower than the fan unit.

The first communication portion may extend to allow the air introduced through the inlet to move in a horizontal direction to a side surface of the fan unit.

The first communication portion may be connected perpendicular to the second communication portion.

The second communication portion may be connected perpendicular to the third communication portion.

Advantageous Effects of Invention

In accordance with the present invention, dust may be efficiently suctioned into an area in which a suction unit is located, which may improve cleaning performance. Widely distributed dust may be suctioned using the same suction force, which may increase the efficiency for a given suction force. In addition, it is possible to prevent unnecessary power from being consumed to increase the suction force, which may improve energy efficiency. In addition, it is possible to prevent an increase in noise caused when the suction force is increased.

In addition, according to the present invention, air and dust may be uniformly distributed throughout an area of the suction unit, which may ensure the efficient suction of dust to the suction unit. That is, the suction force may be widely and uniformly distributed in a suction port, through which the dust may be suctioned, in the surface of the suction unit that faces a surface to be cleaned, which may increase suction efficiency.

In addition, according to the present invention, the amount of noise transmitted from the robot cleaner to the user may be reduced, which may reduce inconvenience of the user during the operation of the robot cleaner. The path along which the generated noise is directly transferred to the user may be shielded.

In addition, according to the present invention, a battery may be cooled during the operation of the robot cleaner, which may increase the efficiency of use of the battery. In addition, it is possible to prevent other constituent elements of the cleaner from being damaged by the heat generated in the battery. Because no separate device is used in order to cool the battery, the overall energy efficiency of the robot cleaner may be increased.

In addition, according to the present invention, because the battery is cooled as air is supplied to the battery as soon as the battery is driven without requiring to sense the state of the battery in order to cool the battery, it is unnecessary to provide additional constituent elements for sensing the state of the battery, which may result in a simplified structure.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view of a robot cleaner according to the present invention;

FIG. 2 is a bottom view of the robot cleaner illustrated in FIG. 1;

FIG. 3 is a side view illustrating a major part according to one embodiment of the present invention;

FIG. 4 is a view illustrating FIG. 3 when viewed from the top side;

FIG. 5 is a view for explaining a suction unit;

FIGS. 6 to 8 are views for explaining the effect of the present invention;

FIG. 9 is a side view illustrating another major part according to one embodiment of the present invention;

FIG. 10 is an exploded perspective view of FIG. 9;

FIG. 11 is a view for explaining various embodiments of a cover portion;

FIG. 12 is a side view illustrating a further major part according to one embodiment of the present invention;

FIG. 13 is a view for explaining the flow of air in FIG. 12;

FIG. 14 is a view for explaining an alternative embodiment;

FIG. 15 is a schematic view of FIG. 14;

FIG. 16 is a view illustrating another alternative embodiment;

FIG. 17 is a view illustrating a portion of a lower surface illustrated in FIG. 16;

FIG. 18 is a view for explaining a housing illustrated in FIG. 16.

BEST MODE FOR CARRYING OUT THE INVENTION

Hereinafter, exemplary embodiments of the present invention will be described in detail with reference to the accompanying drawings in order to concretely realize the objects as set forth above.

In the drawings, the sizes or shapes of components may be exaggerated to emphasize more clearly the explanation in the drawings and for convenience. In addition, the terms, which are specially defined in consideration of the configuration and operations of the present invention, may be replaced by other terms based on the intensions of users and operators or customs. The meanings of these terms should be construed based on the whole content of this specification.

FIG. 1 is a perspective view of a robot cleaner 100 according to the present invention, and FIG. 2 is a bottom view of the robot cleaner 100 illustrated in FIG. 1.

Referring to FIGS. 1 and 2, the robot cleaner 100 performs a cleaning function by suctioning dust (including impurities) from the floor while autonomously traveling in a certain area.

The robot cleaner 100 includes a cleaner main body 101, a controller (not illustrated), and a moving unit 110, in order to perform a moving function.

The cleaner main body 101 is configured to accommodate inner constituent elements therein and to be moved on the floor surface via the operation of the moving unit 110. For example, a controller for controlling the operation of the robot cleaner 100, a battery (not illustrated) for supplying power to the robot cleaner 100, an obstacle detection sensor 103 for enabling the avoidance of obstacles during traveling, and a damper 104 for absorbing shocks upon collision with obstacles may be accommodated or mounted in the cleaner main body 101.

The moving unit 110 may move the cleaner main body 101 leftward and rightward and forward and rearward, and may include main wheels 111 and an auxiliary wheel 112.

The main wheels 111 are provided respectively on opposite sides of the cleaner main body 101 and are configured to be rotatable in a given direction or in the opposite direction in response to a control signal. The respective main wheels 111 may be configured to be driven independently of each other. For example, the respective main wheels 111 may be driven by different motors.

Each of the main wheels 111 may be formed as a combination of wheels 111*a* and 111*b*, which have different radii about a rotation axis. With this structure, when the main wheels 111 go up an obstacle, such as a raised portion, at least one wheel 111*a* and 111*b* may come into contact with the obstacle so that the main wheels 111 pass over the obstacle without spinning with no traction.

The auxiliary wheel 112 is configured to support the cleaner main body 101 in cooperation with the main wheels 111, and to assist in the movement of the cleaner main body 101 by the main wheels 111.

In an embodiment of the present invention, a dust separation unit for separating dust and air from each other will be described by citing a cyclone unit as an example. Some embodiments, which describe configurations not using a cyclone, may be applied to a technology of separating dust and air from each other by passing the same through a filter, without being limited to the cyclone unit, which separates dust using rotational force.

FIG. 3 is a side view illustrating a major part according to one embodiment of the present invention, FIG. 4 is a view illustrating FIG. 3 when viewed from the top side, and FIG. 5 is a view for explaining a suction unit.

Referring hereinafter to FIGS. 3 to 5, the robot cleaner according to one embodiment of the present invention includes a fan unit 120 mounted in the cleaner main body 101 for generating suction force, a suction unit 130 provided in the cleaner main body 101 and having a suction port 131, into which air containing dust is suctioned via the driving of the fan unit 120, and a first discharge port 134 and a second discharge port 136 for discharging the air containing the dust, a first guide member 160 coupled to the first discharge port 134, a second guide member 170 coupled to the second discharge port 136, and a cyclone unit 150 for separating the dust from the air suctioned through the suction port 131 using centrifugal force, the cyclone unit 150 having a first communication hole 152 for communicating with the first guide member 160 and a second communication hole 154 for communicating with the second guide member 170.

At this time, the air guided by the first guide member 160 and the air guided by the second guide member 170 are mixed with each other in the cyclone unit 150.

The fan unit 120 provides suction force to enable the suctioning of the air and the dust through the suction unit 130. When the dust and the air suctioned through the suction unit 130 pass through the cyclone unit 150, the dust may move to a dust container (not illustrated) and the air may be discharged outward by the suction force of the fan unit 120. The user can discard the collected dust by removing the dust container.

The suction unit 130 may suction the air and the dust adhered to a surface to be cleaned while providing the suction force to the surface to be cleaned.

The suction unit 130 may be provided with an inner space for the formation of a flow path, through which the air and the dust may move. The suction port 131 is formed in a bottom surface 132 of the suction unit 130, and the first discharge port 134 and the second discharge port 136 are formed in a rear surface of the suction unit 130.

Accordingly, the dust and the air, suctioned through one suction port 131, may be divided and move to two discharge ports, i.e. the first discharge port 134 and the second discharge port 136.

The suction unit 130 may include a separator 137 for separating the first discharge port 134 and the second discharge port 136 from each other. The separator 137 may include a first partition 137*a* for guiding the air to the first discharge port 134 and a second partition 137*b* for guiding the air to the second discharge port 136, and the first partition 137*a* and the second partition 137*b* may form an acute angle therebetween.

That is, the air and the dust, suctioned from the suction port 131, may be guided to the first discharge port 134 and the second discharge port 136 without encountering resistance inside the suction unit 130.

The first partition 137*a* and the second partition 137*b* form an acute angle therebetween and the distance between the first partition 137*a* and the second partition 137*b* is reduced with increasing distance from the first discharge port 134 and the second discharge port 136 so that the first partition 137*a* and the second partition 137*b* come into contact with each other at one end thereof.

The suction unit 130 may include a third partition 138 placed to face the first partition 137*a* for guiding the air to the first discharge port 134, and a fourth partition 139 placed to face the second partition 137*b* for guiding the air to the second discharge port 136.

The dust and the air, suctioned through the suction port 131, may be guided to the first discharge port 134 through the first partition 137*a* and the third partition 138. At this time, the first partition 137*a* and the third partition 138 are reduced in cross-sectional area with increasing distance from the suction port 131 and decreasing distance to the first discharge port 134, thereby causing the suction force to be concentrated on the first discharge port 134.

Likewise, the dust and the air, suctioned through the suction port 131, may be guided to the second discharge port 136 through the second partition 137*b* and the fourth partition 139. At this time, the second partition 137*b* and the fourth partition 139 are reduced in cross-sectional area with increasing distance from the suction port 131 and decreasing distance to the second discharge port 136, thereby causing the suction force to be concentrated on the second discharge port 136.

The width of the suction port 131 is greater than the sum of the widths of the first discharge port 134 and the second discharge port 136, and the suction port 131 is formed as a single hole so that the air suctioned through the suction port 131 is divided and guided to the first discharge port 134 and the second discharge port 136.

The suction port 131 may have a width similar to the width of the suction unit 130 so as to provide a surface to be cleaned, over which the suction unit 130 passes, with sufficient suction force to suction all of the dust without exception. When the suction unit 130 has a portion at which the suction port 131 is not formed, there is a possibility of dust being not suctioned into the suction unit 130 even though the suction unit 130 passes over a surface to be cleaned.

Because the first discharge port 134 and the second discharge port 136 have the widths smaller than the suction port 131, the suction force may be concentrated on the first discharge port 134 and the second discharge port 136, and accordingly, the dust having passed through the suction unit 130 may easily move to the cyclone unit 150.

The bottom surface 132 of the suction unit 130 may be inclined upward with decreasing distance to the rear end thereof. Because the suction port 131 is formed in the bottom surface 132 of the suction unit 130 and because the first discharge port 134 and the second discharge port 136 are formed in the rear surface of the suction unit 130, a difference in height may occur between the suction port 131 and the first discharge port 134 or between the suction port 131 and the second discharge port 136.

Owing to the inclination of the bottom surface 132, the dust and the air, suctioned through the suction port 131, may encounter reduced resistance while moving from the suction port 131 to the first discharge port 134 and the second discharge port 136.

In addition, the first partition 137*a*, the second partition 137*b*, the third partition 138, the fourth partition 139, and the bottom surface 132 may be formed of a smooth material in order to allow the dust and the air to encounter a small resistance while passing through the suction unit 130.

The dust and the air, moved inside the suction unit 130, moves to the first guide member 160 through the first discharge port 134. In addition, the dust and the air, moved inside the suction unit 130, moves to the second guide member 170 through the second discharge port 136.

The first communication hole 152 for communicating with the first guide member 160 and the second communication hole 154 for communicating with the second guide member 170 are located on the outer circumference of the cyclone unit 150.

That is, some of the dust and the air, suctioned through the suction port 131, moves to the cyclone unit 150 through the first guide member 160, and the remainder moves to the cyclone unit 150 through the second guide member 170.

In the embodiment of the present invention, the dust and the air are suctioned through one suction unit 130, and are then divided among two guide members, and ultimately moves to one cyclone unit 150, whereby two air streams are mixed and the air and the dust are separated from each other in the cyclone unit 150.

The first guide member 160 and the second guide member 170 may be coupled to the first discharge port 134 and the second discharge port 136 in a direction perpendicular thereto. This serves to allow the air and the dust, discharged from the first discharge port 134 and the second discharge port 136, to move to the first guide member 160 and the second guide member 170 while encountering as little resistance as possible.

The first guide member 160 may be coupled to the first communication hole 152 so as to extend in the tangential direction of the cyclone unit 150. In addition, the second guide member 170 may be coupled to the second communication hole 154 so as to extend in the tangential direction of the cyclone unit 150.

The cyclone unit 150 basically separates the air and the dust from each other using the principle of a cyclone. That is, because the dust is relatively heavy particles and the air is relatively light, the dust and the air may be separated from each other while rotating in the cyclone unit 150.

Accordingly, as the dust and the air are introduced into the cyclone unit 150 in the tangential direction of the cyclone unit 150, the cyclone unit 150 may achieve an enhanced separation effect for a given suction force generated by the fan unit 120.

The first guide member 160 and the second guide member 170 function to provide flow paths for the movement of the dust and the air therein, and are connected, at opposite ends thereof, to the first discharge port 134, the second discharge port 136, the first communication hole 152 and the second communication hole 154. The first guide member 160 and the second guide member 170 may not have an abrupt change in the flow path of the air in order to reduce the resistance therein.

The first communication hole 152 and the second communication hole 154 may be arranged at the same height. Of course, the first communication hole 152 and the second communication hole 154 may be arranged at different heights.

Because the dust and the air that are introduced into the cyclone unit 150 through the first communication hole 152 are mixed with the dust and the air that are introduced into the cyclone unit 150 through the second communication hole 154 and then the dust and the air are separated from each other, various alterations of the first communication hole 152 and the second communication hole 154 may be possible based on the shape of the cyclone unit 150.

Of course, when the heights of the first communication hole 152 and the second communication hole 154 are different, the rotational speed of the dust and the air suctioned into the cyclone unit 150 may exhibit uniform distribution over the different heights. This may allow the dust and the air to efficiently rotate inside the cyclone unit 150, resulting in an enhanced efficiency of separation of the dust and the air.

On the other hand, when the first communication hole 152 and the second communication hole 154 are at the same height, the height of the cyclone unit 150 may be reduced, which enables the compact design of the cyclone unit 150.

The cyclone unit 150 may be a multi-cyclone including a first cyclone 156 and a second cyclone 158, and the second cyclone 158 may be provided in a plural number and may be accommodated inside the first cyclone 156.

The multi-cyclone is a technology widely used by those skilled in the art, and thus, a detailed description related to the technology will be omitted. The multi-cyclone is a technology of increasing the efficiency of separation of dust and air while reducing the size of the cyclone unit 150.

The first communication hole 152 and the second communication hole 154 may be located at the upper end of the second cyclones 158. That is, because the dust and the air, suctioned through the first communication hole 152 and the second communication hole 154, are separated from each other by the first cyclone 156 and the second cyclones 158 when being introduced into the cyclone unit 150, arranging the first communication hole 152 and the second communication hole 154 at the upper end of the second cyclones 158 may ensure that the separation of the dust and the air is implemented by sufficiently using the function of the first cyclone 156 and the second cyclones 158.

The first communication hole 152 and the second communication hole 154 may be located on the outer circumference of the cyclone unit 150 so as not to overlap each other when viewed from the top side. When the first communication hole 152 and the second communication hole 154 are located on different portions of the outer circumference, the strength of the cyclone unit 150 may not be reduced despite the provision of the first and second communication holes 152 and 154.

In addition, the robot cleaner according to the present invention may include a cleaner main body defining the external appearance of the robot cleaner, a suction unit having a suction port, through which air containing dust is suctioned from the outside, a first guide member and a second guide member, which are coupled to the suction unit for guiding the movement of the air containing the dust suctioned from the suction port, and a cyclone unit provided in the cleaner main body for separating the air and the dust guided by the first guide member and the second guide member from each other using centrifugal force, the cyclone unit including a first communication hole for communicating with the first guide member and a second communication hole for communicating with the second guide member, the first communication hole and the second communication hole being formed at different heights. The air guided by the first guide member and the air guided by the second guide member are rotated in the same direction to thereby be mixed with each other inside the cyclone unit.

At this time, the second communication hole may be formed above the first communication hole. That is, the first communication hole and the second communication hole may be formed at different heights so that the air having passed therethrough are mixed with each other inside the cyclone unit.

FIGS. 6 to 8 are views for explaining the effect of the present invention.

The following description refers to FIGS. 6 to 8.

FIGS. 6A and 7A are experimental results regarding the state in which only one guide member is provided to guide air and dust to the cyclone unit, and FIGS. 6B and 7B are experimental results regarding the state in which two guide members are provided as in the embodiment of the present invention.

When two guide members are provided under the same condition, the flow rate of air in the guide members is reduced, which allows the air and the dust moving inside the guide members to encounter a small resistance.

In FIG. 8, the dotted line corresponds to the state in which only one guide member is provided, and the solid line corresponds to the state in which two guide members are provided.

It can be checked from FIG. 8 that the provision of two guide members allows the fan unit to provide a reduced pressure when the same flow rate is provided. That is, assuming that the same flow rate of 1 CMM is generated, the fan unit must generate a pressure of 2431 Pa when one guide member is provided, but must generate a pressure of 1712 Pa when two guide members are provided. Therefore, when two guide members are provided as in the present embodiment, the efficiency of suction of the air and the dust as well as the efficiency of separation of the air and the dust may be enhanced.

In conclusion, according to the present embodiment, reduced loss and an increased flow rate may be accomplished compared to the related art, which may increase the overall efficiency.

FIG. 9 is a side view illustrating another major part according to one embodiment of the present invention, and FIG. 10 is an exploded perspective view of FIG. 9.

Referring to FIGS. 9 and 10, the air separated in the cyclone unit 150 moves to the fan unit 120 through a guide 280 illustrated in FIG. 9.

That is, the air having passed through the cyclone unit 150 may be introduced into the guide 280 through an opening 282, and may then pass through the fan unit 120, and may ultimately be discharged outward through a housing 300, which defines a flow path for the discharge of the air from the fan unit 120.

In FIG. 9, the housing 300 is configured to extend from the side surface of the fan unit 120 to a location below the fan unit 120.

The guide 280 may be provided at the top of the fan unit 120 for guiding the movement of the air discharged through the top of the cyclone unit 150.

The fan unit 120 includes a drive motor 200 for generating the flow of air, a first chamber 210 and 212 for surrounding the drive motor 200, the first chamber being provided with a first suction hole 211 and a first exhaust hole 213, and a second chamber 230 and 232 for surrounding the first chamber 210 and 212, the second chamber being provided with a second suction hole 231 and a second exhaust hole 233.

In the present embodiment, the fan unit 120 doubly surrounds the drive motor 200, which generates substantially the greatest noise and vibration, by using the first chamber 210 and 212 and the second chamber 230 and 232, thereby preventing the noise and vibration from being transferred to the user. Accordingly, in the present embodiment, the effect of shielding the noise and vibration from the fan unit 120 may be increased.

The drive motor 200 may generate the flow of air as a rotating shaft thereof is rotated, and consequently, a blade connected to the rotating shaft is rotated. With this flow of air, suction force may be provided to the suction unit 130, and the air containing the dust may be suctioned through the suction unit 130.

The first chamber 210 and 212 includes a first chamber upper member 210 for defining the external appearance of the upper portion, and a first chamber lower member 212 coupled to the first chamber upper member 210 for defining the external appearance of the lower portion. Accordingly, the drive motor 200 may be accommodated in an inner space defined by the coupling of the first chamber upper member 210 and the first chamber lower member 212.

The first suction hole 211 may be formed in the first chamber upper member 210, and the first exhaust hole 213 may be formed in the first chamber lower member 212. At this time, the first suction hole 211 is formed to face the upper side, and the first exhaust hole 213 is formed to face the lateral side.

The first suction hole 211 and the first exhaust hole 213 may be formed to correspond to a suction portion and an exhaust portion of the drive motor 200.

Because the first suction hole 211 and the first exhaust hole 213 are provided in different members, the air may pass through a gently curved path, rather than a sharply bent path, in the first chamber 210 and 212 when the air having passed through the first suction hole 211 is discharged outward through the first exhaust hole 213. Accordingly, the resistance of air passing through the first chamber 210 and 212 may be reduced, which may increase the suction force generated by the drive motor 200.

In order to absorb vibrations caused when the drive motor 200 generates the flow of air via rotation thereof, the first chamber lower member 212 may include a first vibration attenuator 216, which comes into contact with the bottom of the drive motor 200 so as to support the drive motor 200.

The first chamber upper member 210 may include a second vibration attenuator 218, which comes into contact with the top of the drive motor 200 so as to support the drive motor 200.

Because the drive motor 200 is supported at the top thereof by the second vibration attenuator 218 and at the bottom thereof by the first vibration attenuator 216, the drive motor 200 does not come into contact with the first chamber upper member 210 or the first chamber lower member 212.

The first vibration attenuator 216 and the second vibration attenuator 218 may be formed of an elastically deformable material so as to absorb vibration, and may be formed of, for example, a rubber material. The first vibration attenuator 216 and the second vibration attenuator 218 absorb vibrational energy while being deformed when the drive motor 200 generates vibrations, thereby reducing the amount of vibration and noise generated by the vibration.

The first vibration attenuator 216 and the second vibration attenuator 218 may not be located on an air movement path inside the first chamber 210 and 212, and thus may not cause a reduction in suction force. That is, the first vibration attenuator 216 may be placed on the coupling plane at which the drive motor 200 and the first chamber lower member 212 are coupled to each other, and the second vibration attenuator 218 may be placed on the coupling plane at which the drive motor 200 and the first chamber upper member 210 are coupled, whereby the first vibration attenuator 216 and the second vibration attenuator 218 are located in an area at which no movement of air occurs.

The first exhaust hole 213 may be formed so as to be distributed in the entire side surface of the first chamber lower member 212, and may be located to correspond to an air discharge portion of the drive motor 200.

The second chamber 230 and 232 includes a second chamber upper member 230 for defining the external appearance of the upper portion and a second chamber lower member 232, which is coupled to the second chamber upper member 230 for defining the external appearance of the lower portion.

Because the first chamber 210 and 212 is completely accommodated in an inner space defined by the coupling of the second chamber upper member 230 and the second chamber lower member 232, noise and vibration generated by the first chamber 210 and 212 may be shielded by the second chamber 230 and 232.

In addition, because the second chamber 230 and 232 is divided into two members, i.e. the second chamber upper member 230 and the second chamber lower member 232, the coupling of the first chamber 210 and 212 and the second chamber 230 and 232 may be easily performed.

The second suction hole 231 may be formed in the second chamber upper member 230, and the second exhaust hole 233 may be formed in the second chamber lower member 232. The second suction hole 231 may be formed to face the upper side, and the second exhaust hole 233 may be formed to face the lateral side. When the second suction hole 231 and the second exhaust hole 233 are formed in different members, i.e. the second chamber upper member 230 and the second chamber lower member 233, it is possible to prevent the air having passed through the second suction hole 231 from being discharged to the second exhaust hole 233 along a sharply bent path inside the second chamber 230 and 232.

The first suction hole 211 and the second suction hole 231 may be arranged to face each other so that the air having passed through the second suction hole 231 easily moves to the first suction hole 211.

In addition, the first exhaust holes 213 and the second exhaust hole 233 may be arranged to face each other so that the air discharged from the first exhaust holes 213 is discharged to the second exhaust hole 233 without encountering a high resistance.

The second exhaust hole 233, formed in the second chamber lower member 232, may be provided with an exhaust filter 290 so that the dust is repeatedly caught when passing through the second exhaust hole 233.

The exhaust filter 290 seals the second exhaust hole 233 so that the second exhaust hole 233 is not completely exposed, but allows the passage of air therethrough. Therefore, it is possible to prevent noise generated inside the second chamber 230 and 232 from being transferred to the outside of the second chamber 230 and 232.

The second suction hole 231 is formed in the upper surface of the second chamber upper member 230, and a seating piece 234 is provided on the upper surface so as to protrude by a predetermined height.

The seating piece 234 may be inclined to ensure easy coupling with the guide 280.

A sealing member 240 is provided on the upper surface of the seating piece 234, and the guide 280 is placed above the sealing member 240. The sealing member 240 may be formed along the outer rim of the seating piece 234 so as to seal the gap between the guide 280 and the seating piece 234.

The guide 280 causes the air, introduced in the horizontal direction through the opening 282, to move in a vertical path inside the guide 280, thereby guiding the air to the second suction hole 231.

In addition, the fan unit 120 according to the present embodiment includes a cover 250, which is placed at the upper side of the second suction hole 231 and prevents noise generated by the drive motor 200 from being emitted through the second suction hole 231.

The cover 250 may be placed at the upper side of the second suction hole 231 so as to prevent the noise generated in the second chamber 230 and 232 from propagating outward through the second suction hole 231.

The cover 250 includes a cover portion 252 for blocking the path of noise propagating through the second suction hole 231, and a support portion 254 for seating the cover portion 252 on the top of the second chamber 230 and 232.

The support portion 254 includes a support piece 255 seated on the top of the second chamber 230 and 232, and an arm 256 fixed to the top of the cover portion 252. The cover portion 252 may be spaced apart from the second suction hole 231.

The cover 250 may prevent the movement of air introduced through the guide 280. Because the cover 250 is located at the upper side of the second suction hole 231, the cover 250 may block the path of air vertically moving from the upper side of the cover 250 to the second suction hole 231.

Accordingly, the cover 250 may prevent the propagation of noise, whereas the support portion 254 for fixing the cover 250 may not prevent the movement of air.

The arm 256 may be formed as a member having a width smaller than the height thereof in order to reduce the resistance of the air moving from the guide 280 to the second suction hole 231. The support piece 255 and the arm 256 may have the same thickness, in order to allow the cover portion 252 to be located at the center of the second suction hole 231 and to reduce the flow resistance of the air.

The cover portion 252 may have an upper portion having a smaller cross-sectional area than a lower portion thereof. With this shape, the air above the cover portion 252 may easily move to the second suction hole 231, which is located below the cover portion 252.

The cover portion 252 may have a recess 253 formed therein, and the recess 253 may be located so as to face the second suction hole 231. The recess 253 may serve to further attenuate noise that propagates upward through the second suction hole 231. Accordingly, the noise attenuation effect of the cover 250 may be increased.

When viewed from the top, the cover portion 252 may have a greater cross-section area than the second suction hole 231. Accordingly, the cover portion 252 may shield the noise propagated upward through the second suction hole 231.

The cover portion 252, which covers the entire second suction hole 231, may be spaced upward apart from the second suction hole 231 by a predetermined height so as to define a space between the cover portion 252 and the second suction hole 231. The air may be guided to the second suction hole 231 through the space between the cover portion 252 and the second suction hole 231.

The cover 250 is located between the opening 282 and the second suction hole 231.

The guide 280 may include a mesh 260 for widely distributing the air having passed through the cyclone unit 150. Because the mesh 260 has a plurality of holes, the air moving from the top to the bottom of the mesh 260 by passing through the mesh 260 may be uniformly distributed over the cross-sectional area of the mesh 260. That is, the air passing through the mesh 260 is not concentrated on the cover portion 252 and some of the air moves to the outer periphery of the cover portion 252, which may reduce deterioration in suction force caused when the flow of air is concentrated on the cover portion 252.

The procedure by which the air having passed through the cyclone unit 150 passes through the guide 280, the fan unit 120 and the housing 300 will be described with reference to FIGS. 9 and 10.

The air filtered by the cyclone unit 150 passes through the opening 282 to thereby be introduced into the guide 280.

The air is uniformly spread by the mesh 260 inside the guide 280, and passes through the outer periphery of the cover portion 252 to thereby be introduced into the second suction hole 231. Because the support portion 254 does not greatly block the path of air, the flow of air is not greatly affected by the support portion 254.

The air is suctioned through the second suction hole 231 and the first suction hole 211 in sequence, and is introduced into the drive motor 200.

Then, the air discharged from the drive motor 200 sequentially passes through the first exhaust holes 213 and the second exhaust hole 233, and is discharged to the housing 300.

Noise and vibration generated while the drive motor 200 is driven may be reduced by the first vibration attenuator 216 and the second vibration attenuator 218. In addition, because the first chamber and the second chamber doubly surround the drive motor 200, the vibration and noise are not transferred to the user.

In addition, the cover 250 is spaced upward apart from the second suction hole 231 so as to cover the second suction hole 231, thereby shielding the noise generated from the drive motor 200.

FIG. 11 is a view for explaining various embodiments of the cover portion.

Referring to FIG. 11, the cover portion 252 has an upper portion having a smaller cross-sectional area than a lower portion thereof. That is, the cover portion 252 may be shaped to reduce the flow resistance of air.

The cover portion 252 may have a recess 253 formed in the lower surface thereof so as to shield some of the noise propagating upward from the lower side thereof. At this time, the cover portion 252 may have a consistent thickness, or may have different thicknesses in different portions thereof.

A second communication portion may be provided to downwardly move the air to a location below the fan unit 120.

A first communication portion may be provided to extend at a height similar to the height of the fan unit 120 so as to receive the air discharged from the fan unit 120.

The second communication portion may be connected perpendicular to the first communication portion so that the air moves to a height below the fan unit 120 in the second communication portion.

A third communication portion may be connected perpendicular to the second communication portion so that the air may be continuously maintained at a lower height than the fan unit 120 in the third communication portion.

The first communication portion and the third communication portion may be provided at different heights and the air may move in opposite directions in first communication portion and the third communication portion.

FIG. 12 is a side view illustrating a further major part according to one embodiment of the present invention, and FIG. 13 is a view for explaining the flow of air in FIG. 12.

FIGS. 12A and 13A illustrate an example in which no protrusion is formed in the housing, and FIGS. 12B and 13B illustrate an example in which a protrusion is formed in the housing.

Referring to FIG. 12A, the entire housing 300 is located at the rear side of the fan unit 120 and at the lower side of the fan unit 120.

FIG. 12A illustrates some components of the cleaner according to the embodiment of FIG. 3. In FIG. 12A, the suction unit 130, the dust separation unit 150, and the fan unit 120 are arranged in sequence from the front side to the rear side. At this time, the left side of FIGS. 3 and 12A correspond to the front side of the robot cleaner, and the right side of FIGS. 3 and 12A correspond to the rear side of the robot cleaner.

The housing 300 is provided with an air flow path for guiding the air discharged from the fan unit 120. Thereby, the air having passed through the exhaust filter 290 is introduced into the housing 300 through an inlet 302.

The housing 300 accommodates a battery 400 for supplying electricity to the fan unit 120, and the air passing through the air flow path exchanges heat with the battery 400.

As the battery 400 is charged with electricity by an external power source and the charged electricity is supplied to the fan unit 120, the robot cleaner may perform cleaning while autonomously traveling even if it is not connected to the external power source via a wire.

The air, discharged from the fan unit 120 and guided to the housing 300, may pass through the exhaust filter 290 provided at the inlet 302 so that some of the dust contained in the air may be caught.

The housing 300 includes a first communication portion 310 for guiding the air in a direction perpendicular to the exhaust filter 290, a second communication portion 320 extending from the first communication portion 310 for changing the direction in which the air moves, and a third communication portion 330 extending from the second communication portion 320 for guiding the air in the direction opposite to the direction of movement of air in the first communication portion 310.

The first communication portion 310 is located at the rear side of the fan unit 120, the second communication portion 320 is located below the first communication portion 310, and the third communication portion 330 is located below the fan unit 120. Accordingly, the first communication portion 310, the second communication portion 320, and the third communication portion 330 may be arranged at different positions on the basis of the fan unit 120 so as to guide the direction in which the air discharged from the fan unit 120 moves.

The first communication portion 310 may provide a space through which the air passing through the exhaust filter 290 is movable to the rear side of the exhaust filter 290, i.e. is movable rearward in the same direction as the direction in which the air passes through the exhaust filter 290.

The second communication portion 320 may prevent the resistance of air from being increased, and thus, the flow rate of air from being reduced due to an abrupt direction change when the direction of the air guided through the first communication portion 310 is changed. That is, the second communication portion 320 may be provided between the third communication portion 330 and the first communication portion 310 and may serve as a transition portion for allowing the direction in which the air moves to be gently changed between the first communication portion 310 and the third communication portion 330.

The third communication portion 330 may provide a space in which the air guided through the second communication portion 320 is continuously movable. The air may move in the third communication portion 330 in a direction changed by 180 degrees from the direction in which the air moves in the first communication portion 310.

That is, the housing 300 may guide the direction in which the air discharged from the fan unit 120 moves, and the air may be discharged outward from the housing 300 and the cleaner main body.

The battery 400 may be located in the third communication portion 330.

The first communication portion 310 is a portion in which the air discharged from the fan unit 120 initially moves, and the second communication portion 320 is a portion in which the direction of air having passed through the first communication portion 310 is initially changed. On the other hand, the third communication portion 330 provides a space in which the air having passed through the second communication portion 320 moves a relatively long distance in substantially the same direction, thereby providing a space in which the battery 400 may be installed.

When the battery 400 is located in the third communication portion 330, the battery 400 may come into contact with the air, the flow direction of which is aligned in the third communication portion 330, which may increase heat exchange efficiency. Accordingly, the overheating of the battery 400 may be prevented. In addition, it is possible to prevent the efficiency of the battery 400 from being deteriorated due to the generation of heat in the battery 400.

In the present embodiment, the battery 400 is cooled using the air discharged from the fan unit 120 without consuming additional energy. The fan unit 120 is a constituent element that needs to be driven in order to provide suction force during cleaning, and is not specifically driven in order to cool the battery 400. Therefore, when the fan unit 120 is driven, the flow of air generated by the fan unit 120 is used to cool the battery 400, which may improve the overall energy efficiency.

In addition, the battery 400 generates heat when supplying electricity to the outside, i.e. when driving the fan unit 120. In other words, the battery 400 does not generate heat when not supplying electricity to the outside. Then, when the fan unit 120 is driven, heat is generated in the battery 400 as well as in the fan unit 120. At this time, because the battery 400 may be cooled by the flow of air generated by the fan unit 120, it may be unnecessary to adjust the time during which the air is supplied to the battery 400, which is advantageous.

As illustrated in FIG. 13A, the air discharged from the fan unit 120 may exchange heat with the battery 400 while passing through the first communication portion 310, the second communication portion 320, and the third communication portion 330.

FIG. 12B illustrates an example in which the housing 300 is provided with a protrusion 350 for changing the air into a turbulent flow.

The protrusion 350 protrudes from the inner side surface of the housing 300 and changes the air moving inside the housing 300 from a laminar flow to a turbulent flow.

Turbulent flow means an irregular flow of fluid, and laminar flow means a smooth flow of fluid. Multiple irregular eddies may exist in turbulent flow, and turbulent flow has a greater transportation coefficient and resistance acting on an object than laminar flow. Turbulent flow occurs when the edge of an eddy is curved and the fluid has a high flow rate and low viscosity.

Because a greater amount of air may exchange heat with the battery 400 when turbulent flow, rather than laminar flow, is generated in the housing 300, the efficiency by which the battery 400 is cooled may be increased.

As can be checked from FIG. 13B, when the protrusion 350 is formed, a greater amount of turbulent flow may be generated inside the housing 300.

The protrusion 350 may be provided in the second communication portion 320, which is located before the third communication portion 330 in which the battery 400 is installed. This may cause the turbulent flow generated in the second communication portion 320 to exchange heat with the battery 400, thereby increasing the cooling efficiency.

FIG. 14 is a view for explaining an alternative embodiment, and FIG. 15 is a schematic view of FIG. 14.

Referring to FIG. 14, the suction unit 130, the fan unit 120, and the dust separation unit 150 are arranged in sequence from the front side to the rear side. The left side of FIG. 14 corresponds to the front side of the robot cleaner, and the right side of FIG. 14 corresponds to the rear side of the robot cleaner.

The housing 300 is located at one side of the fan unit 120 to guide the direction in which the air discharged from the fan unit 120 moves.

The lower side of FIG. 15 corresponds to the front side of the robot cleaner, and the left side of FIG. 15 corresponds to the left side of the robot cleaner. Referring to FIG. 15, the first communication portion 310 is located at the front side of the fan unit 120, the second communication portion 320 is located at the left side of the first communication portion 310, and the third communication portion 330 is located at the left side of the fan unit 120.

Accordingly, the battery 400 located in the third communication portion 330 may be cooled by the air discharged from the fan unit 120.

The air discharged forward from the fan unit 120 moves forward of the fan unit 120 along the first communication portion 310. Then, the air moves leftward of the first communication portion 310 along the second communication portion 320, and then moves leftward of the fan unit 120 along the third communication portion 330, thereby cooling the battery 400.

FIG. 16 is a view illustrating another alternative embodiment, FIG. 17 is a view illustrating a portion of the lower surface illustrated in FIG. 16, and FIG. 18 is a view for explaining the housing illustrated in FIG. 16.

Referring to FIG. 16, the suction unit 130, the fan unit 120, and the dust separation unit 150 are arranged in sequence from the front side to the rear side. The left side of FIG. 16 corresponds to the front side of the robot cleaner, and the right side of FIG. 16 corresponds to the rear side of the robot cleaner.

Referring to FIGS. 16 to 18, the first communication portion 310 is located below the fan unit 120, the second communication portion 320 is located at the right side of the first communication portion 310, and the third communication portion 330 is located at the right side of the fan unit 120.

The air discharged from the exhaust filter 290 moves along the first communication portion 310 in a direction perpendicular to the cross section of the exhaust filter 290, and is changed in direction along the second communication portion 320.

Then, the direction in which the air moves is completely changed in the third communication portion 330 so that the battery 400 is cooled by the air.

After passing through the housing 300, the air may be discharged outward through an outlet 306.

As illustrated in FIG. 18, the second communication portion 320 may be provided with a plurality of protrusions 350 so that the air moving inside the housing 300 forms a turbulent flow, rather than a laminar flow. Accordingly, the efficiency by which the air passing through the housing 300 exchanges heat with the battery 400 may be increased.

The present invention is not limited to the embodiments described above, various other alterations of the embodiments are possible by those skilled in the part as can be appreciated from the accompanying claims, and these alterations fall within the scope of the present invention.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a robot cleaner.

The invention claimed is:

1. A cleaner comprising:

a cleaner main body defining an external appearance of the cleaner;

a fan unit mounted in the cleaner main body to generate suction force;

a suction unit coupled to the cleaner main body and having a suction port to suction air containing dust via driving of the fan unit and a first discharge port and a second discharge port to discharge the air containing the dust;

a first guide member coupled to the first discharge port;

a second guide member coupled to the second discharge port; and a cyclone unit to separate the dust from the air suctioned through the suction port using centrifugal force, the cyclone unit having a first communication hole communicating with the first guide member and a second communication hole communicating with the second guide member, wherein the air guided by the first guide member and the air guided by the second guide member are mixed with each other in the cyclone unit and wherein the first guide member and the second guide member are coupled perpendicularly to the first discharge port and the second discharge port.

2. The cleaner according to claim 1, wherein the suction unit includes a separator to separate the first discharge port and the second discharge port from each other.

3. The cleaner according to claim 2, wherein the separator includes a first partition to guide the air to the first discharge port and a second partition to guide the air to the second discharge port, and wherein the first partition and the second partition are positioned to form an acute angle therebetween.

4. The cleaner according to claim 3, wherein the suction unit includes:

a third partition placed to face the first partition to guide the air to the first discharge port; and a fourth partition placed to face the second partition to guide the air to the second discharge port.

5. The cleaner according to claim 1, wherein the suction port has a width greater than a sum of widths of the first discharge port and the second discharge port, and wherein the suction port is formed as a single hole, and the air suctioned through the suction port is divided and guided to the first discharge port and the second discharge port.

6. The cleaner according to claim 1, wherein the suction port is located in a bottom surface of the suction unit, and wherein the first discharge port and the second discharge port are located in a rear surface of the suction unit.

7. The cleaner according to claim 6, wherein the bottom surface of the suction unit is inclined upward with decreasing distance to a rear end of the suction unit.

8. The cleaner according to claim 1, wherein the first communication hole and the second communication hole are located on an outer circumference of the cyclone unit.

9. The cleaner according to claim 8, wherein the first guide member is coupled to the first communication hole so as to extend in a tangential direction of the cyclone unit.

10. The cleaner according to claim 8, wherein the second guide member is coupled to the second communication hole so as to extend in a tangential direction of the cyclone unit.

11. The cleaner according to claim 8, wherein the first communication hole and the second communication hole are positioned at a same height.

12. The cleaner according to claim 8, wherein the first communication hole and the second communication hole are positioned at different heights.

13. The cleaner according to claim 8, wherein the cyclone unit is a multi-cyclone including a first cyclone and a second cyclone, and wherein the second cyclone is provided in a plural number and is accommodated inside the first cyclone.

14. The cleaner according to claim 13, wherein the first communication hole and the second communication hole have lower ends located on an upper end of the second cyclone.

15. The cleaner of claim 1, further comprising:

at least one wheel that is rotates based on receiving a driving force to move the cleaner main body within a cleaning region.

16. The cleaner of claim 1, wherein the suction port is opened to a surface to be cleaned.

17. The cleaner of claim 1, wherein the fan unit receives air filtered through the cyclone unit and outputs air to a housing provided at a side of the fan unit, and wherein one of the first guide member or the second guide members extends over the housing.

18. The cleaner of claim 1, wherein the fan unit is positioned between the suction unit and the cyclone unit.

19. The cleaner of claim 18, wherein the first guide member extends around a first lateral side of the fan unit, and the second guide member extends around a second lateral side of the fan unit.

20. The cleaner of claim 1, wherein the cyclone unit is positioned between the suction unit and the fan unit.

* * * * *